United States Patent [19]

Hansen

[11] Patent Number: 4,841,270

[45] Date of Patent: Jun. 20, 1989

[54] HEAT-DISTRIBUTING WINDING

[75] Inventor: Ove Hansen, Bogense, Denmark

[73] Assignee: Transpower A/S, Denmark

[21] Appl. No.: 144,005

[22] Filed: Jan. 15, 1988

[30] Foreign Application Priority Data

Jan. 19, 1987 [DK] Denmark ..... 267/87

[51] Int. Cl.[4] ..... H01F 27/22

[52] U.S. Cl. ..... 336/61; 336/205; 336/223; 336/229

[58] Field of Search ..... 336/61, 55, 148, 149, 336/229, 188, 205, 223

[56] References Cited

U.S. PATENT DOCUMENTS

| | | | |
|---|---|---|---|
| 2,399,382 | 4/1946 | Polydoroff | 336/188 X |
| 2,442,310 | 5/1948 | Polydoroff | 336/188 X |
| 3,160,842 | 12/1964 | Neumann et al. | 336/148 X |
| 3,218,547 | 11/1965 | Ling | 336/229 X |
| 3,230,488 | 1/1966 | Jacob | 336/229 X |
| 3,390,364 | 6/1968 | Russell | 336/229 X |
| 3,426,269 | 2/1969 | Schonstedt | 336/229 X |
| 3,698,660 | 10/1972 | Mobley | 336/188 X |
| 4,204,087 | 5/1980 | Lin et al. | 336/223 |

FOREIGN PATENT DOCUMENTS

| | | | |
|---|---|---|---|
| 987694 | 1/1983 | U.S.S.R. | 336/229 |

*Primary Examiner*—Thomas J. Kozma

*Attorney, Agent, or Firm*—Sughrue, Mion, Zinn, Macpeak & Seas

[57] ABSTRACT

A heat-distributing winding for the equalization of uneven heating of the winding parts of an annular core transformer including a winding concentric with the core and made from juxtaposed turns of wire-shaped heat-conducting material substantially perpendicular to and in heat-conductive contact with, but electrically insulated from the winding parts extending along the cylindrical external surface of the core and mainly in the generatrix direction of said core. The heat-distributing winding is applied to the inner side of or on either side of said above mentioned winding parts of the transformer and consists of turns electrically insulated from each other and consisting of wire of for instance rectangular cross-section.

3 Claims, 1 Drawing Sheet

HEAT-DISTRIBUTING WINDING

Figure 1:
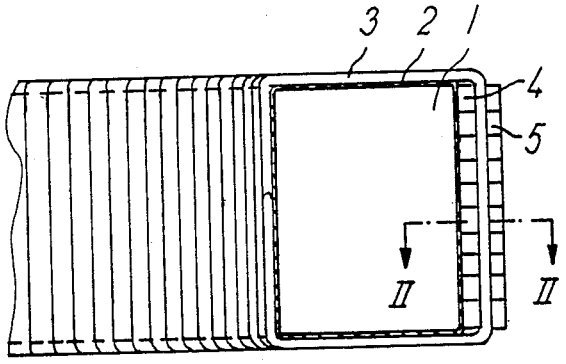

This invention relates to a heat-distributing winding for the equalization of uneven heating of the winding sections of an annular core transformer.

While the iron losses of an annular core transformer are uniformly spread over the iron core of the transformer and consequently will cause a uniform heating thereof, the copper losses will be dominant in the section of the winding conducting the highpowered current in case the entire welding is wound with the same thickness of wire as it will partricularly be the case with a variable transformer.

In a variable transformer comprising an annular core including a winding, the individual turns of which made from insulated wire in a circular area close to the circumference of the end faces of the core are adjacently arranged and are laid open over a part of the circular area at at least one end surface to form a circular contact path in such a manner that a current brush mounted on a rotor capable of rotating about the axis of the core may be connected with an arbitrary turn, the current and thus the copper loss per turn in the smallest part of the sections into which the winding is divided up by the current brush be larger than in the other section of the winding. This entails that the first section of windings is heated more intensely than the second one. In a variable transformer there will, moreover, occur a supplementary heating of the turn that is for instance short-circuited by the current brush.

Due to the contact resistance at the point where the current brush gets into contact with the winding said brush, moreover, gives rise to local heating. According to SE Pat. No. 217 746 an attempt has been made to eliminate said last mentioned local heating by inserting a heat-distributing ring beneath the contact path of the winding. This measure contributes only very slightly to the equalization of said remaining local heatings which according to the prior art merely have been taken into account by dimensioning the transformer so that the most heavily loaded parts of the winding obtain the needed coiling, meaning in practice that the transformer as a whole becomes over-dimensioned.

It is the object of the invention to provide a heat-distributing winding that makes it possible to diminish the dimensions of a transformer adapted to a determined current strength.

This is obtained by a heat-distributing winding which according to the invention is characterized in that the winding includes a winding concentric with the core and made from juxtaposed turns of wire-shaped heat-conducting material substantially perpendicular to and in heat-conductive contact with, but electrically insulated form the winding parts extending along the cylindrical external surface of the core and mainly in the generatrix direction of said core.

Besides an effective distribution of heat from locally supplementarily heated turns all over the circumference of the transformer, said winding for conducting away heat provides for obtaining a good mechanical protection of the otherwise vulnerable winding parts along the outer circumference of the transformer. Morever, the winding offers a certain electrical shielding of the transformer and makes it suited for installation and encasement to obtain a complete shielding.

The disadvantageous heating of the contact point of the brush characteristic of variable transformers is eliminated to a certain extend, particularly as regards bigger transformers, since the heat conductivity in the longitudinal direction of the electrical winding intensifies considerably with thicker wires in comparison with the dissipation to the narrow contact ring. Heat conducted in the longitudinal direction of the electrical winding wire is transferred to the external surface of the core where the electrical winding wire over a considerable part is in heat-conducting contact with the heat-conducting winding.

It is certainly known from DE-OS No. 20 42 035 to make use of a heat dissipation sheet having the same positioning as the heat distributing winding according to the invention, but the use of the winding of juxtaposed turns of filamentous material provides for obtaining evident advantages as regards production and reliability.

In the stage of production a sheet-shaped conduit for dissipation of heat must be formed separately for each individual type of transformer by use of a moulding tool corresponding to the desired shape, following which it is pressed down across the transformer windings at the risk of damaging them, and it is difficult to ensure heat contact between the individual turns of the transformer winding and the sheet.

Contrary to the above, the heat distributing winding according to the invention is favourable in that the wire on being wound directly round the winding of the transformer does not need be shaped beforehand. While being wound around the wire does not grind against the insulation of the transformer windings and the wire is so flexible that it always can be further tightened during winding up so that it follows minor inaccuracies in the cylindrical surface of the transformer winding. Eventually, the same type of wire can be used for the heat-distributing winding of different types of transformers.

With respect to operation the heat-distributing winding accoridng to the invention also differs favourably in relation to the sheet solution disclosed in the above mentioned German Offenlegungsschrift, the vortex losses in a heat-distributing winding according to the invention having turned out to be negligible, while experiments on the sheet solution have shown rises in transformer losses in the range of 55 to 60%.

A heat-distributing winding according to the invention may be applied to already existing transformers. In a new production of transformers a heat-distributing winding may be provided both on the inner face and the outer face of the winding parts extending along the cylindrical external surface of the core.

In order to prevent the stray field of the transformer from provoking vortex losses in the heat-distributing winding the turns thereof may according to the invention be electrically insulated from one another.

To obtain the optimum heat contact between the electrical winding and the heat-distributing winding at least one of said windings may according to the invention be made of wire of rectangular cross-section.

Figure 2:
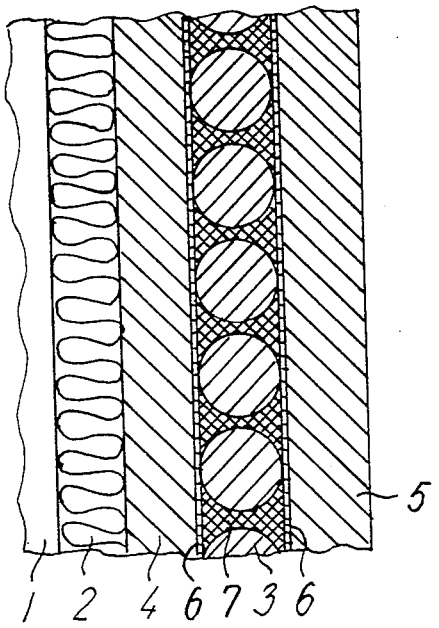

The invention will now be explained in detail with reference to the drawing, in which FIG. 1 is a radial section through an annular core transformer with heat-distributing windings according to the invention, and FIG. 2 is a section on a larger scale along the lines II—II in FIG. 1, FIG. 1 is a radial view through an annular core transformer with an iron core 1 encircled by an insulating material 2 around which an electrical winding 3 is wound. In heat-conductive contact with the part of the electrical winding 3 extending along the cylindrical external surface of the core, windings 4 and 5 are laid concentrically with the core, the winding 4 being laid on the inner face and winding 5 on the outer face of the wires of the electrical winding 3 extending along the cylindrical external surface of the core in the generatrix direction thereof. The heat-distributing windings extend substantially perpendicular to the electrical winding threads and are separated therefrom by a thin electrically insulating layer 6, as illustrated in FIG. 2.

FIG. 2 illustrates in more detail the structure of the winding with insulating material 2 round the iron core 1, the internal heat-distributing winding 4, a thin electrically insulating layer 6, the electrical winding 3 where the spaces between the individual turns of said winding are cast by a heat-conductive mass 7, still a thin electrically insulating layer and eventually the outer heat-distributing winding 5.

The heat-distributing winding is suitably made from metal wire, preferably aluminum wire surrounded by an electrically insulating layer so that the individual turns are insulated from each other. The heat-distributing wires are here illustrated having rectangular cross-section and the electrical winding wires are illustrated having circular cross-section, but also other cross-sectional forms and combinations thereof are applicable.

In comparison with transformers without the winding object of this invention definite experiments practising the heat-distributing winding according to the invention have shown a temperature recuction of approximately 20° C. in the locally heated areas at the expense of an unimportant uniformly distributed heating of the total transformer.

I claim:

1. An annular core transformer comprising; a cylindrical core with external and internal cylindrical surfaces and end surfaces connecting said cylindrical surfaces, a toroidal electrical winding wound on said core with parts of the winding extending along the cylindrical surfaces of the core, and parts of the winding extending along the end surfaces of the core the turns of the winding mainly following the generatrix direction along the cylindrical surfaces, at least one heat heat distributing winding concentric with the core and made from juxtaposed turns of wire-shaped heat conducting material substantially perpendicular to and in heat-conductive contact with, but electricaly insulated from the electrical winding parts extending along the cylindrical external surface of the core and mainly in the generatrix direction of said core , and wherein a heat distributing winding is applied both at an inner surface and an outer surface of the electrical winding parts extending along the cylindrical external surface of the core.

2. The annular core transformer as claimed in claim 1, wherein the individual turns of the heat distribution windings are electrically insulated form one another.

3. The annular core transformer as claimed in claim 1, wherein the heat distributing windings are made from wire of rectangular cross-section.

* * * * *